US007281892B2

(12) United States Patent
Lejars et al.

(10) Patent No.: US 7,281,892 B2
(45) Date of Patent: Oct. 16, 2007

(54) CONTROL LEVER FOR THE PITCH ANGLE OF A BLADE IN A TURBOMACHINE

(75) Inventors: Claude Lejars, Draveil (FR); Bruce Pontoizeau, Paris (FR); Richard Staessen, Chailly en Biere (FR); Nicolas Triconnet, Saint Fargeau (FR)

(73) Assignee: Snecma Moteurs, Paris (FR)

( * ) Notice: Subject to any disclaimer, the term of this patent is extended or adjusted under 35 U.S.C. 154(b) by 293 days.

(21) Appl. No.: 11/045,264

(22) Filed: Jan. 31, 2005

(65) Prior Publication Data

US 2005/0175445 A1 Aug. 11, 2005

(30) Foreign Application Priority Data

Feb. 5, 2004 (FR) ..... 04 01086

(51) Int. Cl.
*F01D 17/16* (2006.01)

(52) U.S. Cl. ..... 415/160

(58) Field of Classification Search ..... 415/160
See application file for complete search history.

(56) References Cited

U.S. PATENT DOCUMENTS 3,788,463 A * 1/1974 Nickles ..... 415/160
3,788,763 A 1/1974 Nickles
2002/0034439 A1 3/2002 Caubet et al.

* cited by examiner

*Primary Examiner*—Richard Edgar
(74) *Attorney, Agent, or Firm*—Oblon, Spivak, McClelland, Maier & Neustadt, P.C.

(57) ABSTRACT

A control lever for the pitch angle of a blade in a turbomachine, said lever having a first end intended to be mounted on a blade pivot so as to rotate it and a second end comprising a cylindrical peg for mounting on a control annulus, this peg being fixed by crimping of one of its ends in an orifice of the second end of the lever and comprising an annular flange to which is applied the second end of the lever, wherein stress distribution means are interposed between the second end of the lever and the crimped end of the peg.

14 Claims, 2 Drawing Sheets

PRIOR ART

CONTROL LEVER FOR THE PITCH ANGLE OF A BLADE IN A TURBOMACHINE

FIELD OF THE INVENTION

The present invention relates to a control lever for the pitch angle of a blade in a turbomachine, in particular for the pitch angle of a straightener in a compressor stage of the turbomachine.

BACKGROUND OF THE INVENTION

The adjustment of the pitch angle of certain stator blades in a turbomachine is intended to optimize the efficiency of this turbomachine and to reduce its fuel consumption in the various flight configurations. This adjustment is generally carried out, for one or more rows of blades, by means of a control annulus which externally surrounds the stator of the turbomachine and which is rotatable about the longitudinal axis of the stator by a drive means such as a ram or an electric motor. The rotation of the annulus is transmitted by control levers of the linkage type to the blades of the row, each control lever being secured to a blade at one of its ends and carrying at its other end a peg which is engaged in a cylindrical housing of the control annulus.

The peg is mounted in an orifice of the end of the lever and is fixed to the lever by crimping, this operation consisting in squashing the end of the peg onto the end of the lever which rests on an annular flange of the peg. This operation engenders significant stresses in that part of the lever on which the crimping of the peg is carried out, thus making this part of the lever more fragile.

When adjusting the pitch angle of the blades, the control lever is subjected to bending forces at its end carrying the peg and the peg is subjected to torsional forces.

The mechanical strength of the lever being decreased by the crimping of the peg, cracks or fissures may appear on the lever after a certain operating time of the turbomachine and cause the breakage of the control lever, which may provoke the shutdown of the turbomachine and must therefore be regarded as a very serious incident.

SUMMARY OF THE INVENTION

The present invention is aimed essentially at eliminating this risk of breakage of the control levers.

Accordingly it proposes a control lever for the pitch angle of a blade in a turbomachine, said lever having a first end intended to be mounted on a blade pivot so as to rotate it and a second end comprising a cylindrical peg for mounting on a control annulus, this peg being fixed by crimping of one of its ends in an orifice of the second end of the lever and comprising an annular flange to which is applied the second end of the lever, wherein stress distribution means are interposed between the second end of the lever and the crimped end of the peg.

Thus, during the crimping of the peg onto the lever, the surface of the lever is no longer in direct contact with the crimped part of the peg and the crimping stresses are distributed over a surface area of the lever that is sufficient to avoid making the lever more fragile.

According to a characteristic of the invention, the stress distribution means comprise a washer. The washer makes it possible to distribute the crimping stresses over a sufficient surface area and has the advantage of being simple and very inexpensive.

In a first embodiment of the invention, the washer is made of a more flexible material than that of the control lever. This allows the washer to absorb the mechanical crimping loads by deforming plastically and to effectively protect the second lever end against any mechanical attack during crimping.

In another embodiment of the invention, the washer is made of a harder material than that of the control lever. This washer has less tendency to deform than in the first embodiment and distributes the crimping stresses better.

In this case to reduce the risks of attack of the second end of the lever, the substantially plane annular surface of the washer, applied to the second end of the lever, exhibits a convex or chamfered annular edge at its outer periphery.

In a general manner, an advantage of the present invention is the simple, effective and inexpensive avoidance of the risks of breakage of the control levers for the pitch angle of the straighteners of the compressor stages in a turbomachine, which might result from the crimpings of the pegs at the ends of the levers.

BRIEF DESCRIPTION OF THE DRAWINGS

Other advantages and characteristics of the invention will become apparent from reading the following description given by way of non-limiting example and with reference to the appended drawings in which.

DESCRIPTION OF THE PREFERRED EMBODIMENTS

Figure 1:
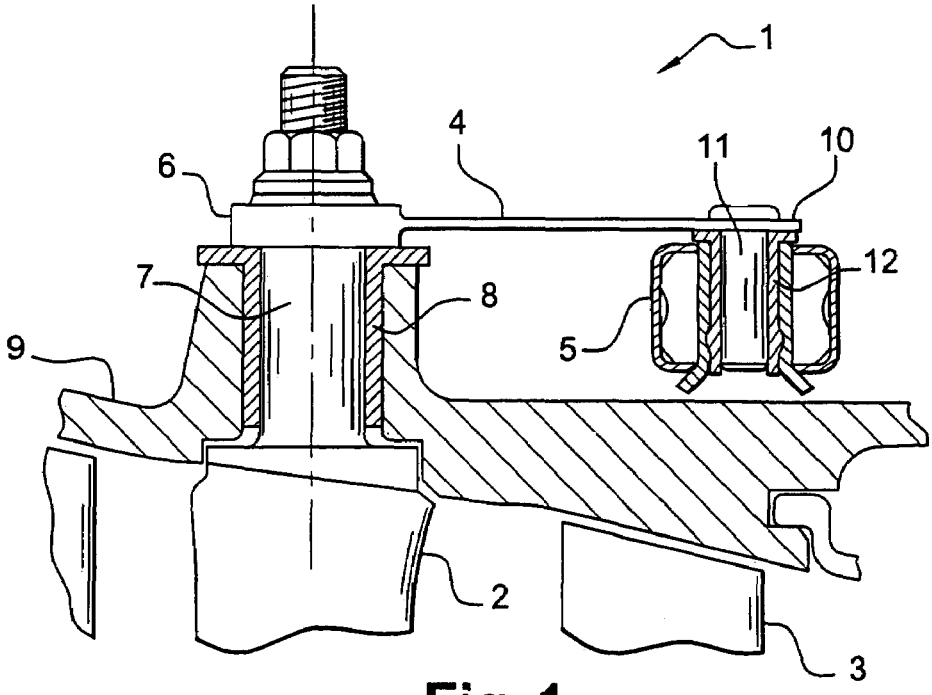
Fig. 1 PRIOR ART
FIG. 1 is a partial diagrammatic view illustrating the mounting of a control lever for the pitch angle of a straightener in a compressor stage of a turbomachine, according to the prior art.

Represented in FIG. 1 is a part of a high-pressure compressor stage 1 of a turbomachine, in which each stage of the compressor comprises a row of blades 2 mounted on the stator and a row of blades 3 carried by the rotor.

The blades 2 of the stator are straighteners whose angular orientation is adjustable with the aid of control levers 4, rotated by a control annulus 5 actuated by a ram or an electric motor.

Each control lever 4 is fixed by an end 6 to a radial pivot 7 of a blade 2, the pivot 7 being guided in rotation in a bearing 8 mounted in a radial orifice of the casing 9. The other end 10 of the control lever 4 carries a peg 11 which is crimped to this end 10 of the control lever 4 and is guided in rotation in a cylindrical socket 12 of the control annulus 5.

An angular movement of the control annulus 5 about its axis is manifested as a rotation of the levers 4 about the axes of the pivots 7 and by the rotating of the blades 2 about these axes.

Figure 2:
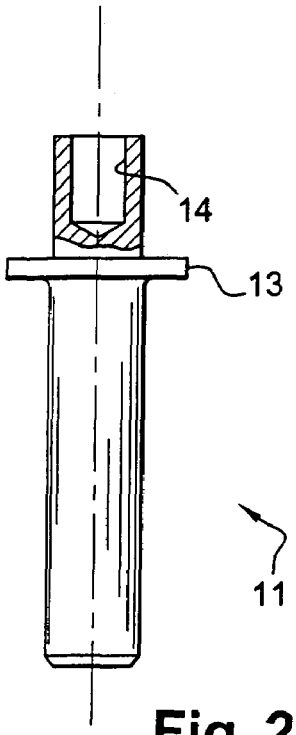
Fig. 2 PRIOR ART
FIGS. 2 and 3 are diagrammatic side views illustrating the crimping of the peg onto the control lever in the prior art.
Figure 3:
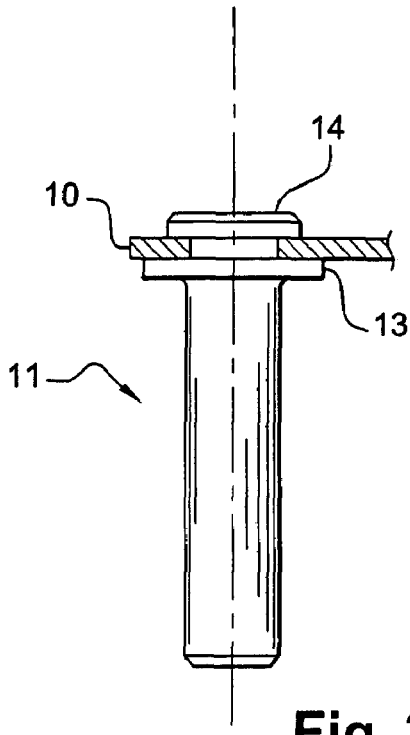

FIGS. 2 and 3 illustrate the crimping of a peg 11 onto the end 10 of the control lever in the known art, the peg generally being made of steel and the lever of titanium.

Before crimping, the peg is a straight cylindrical element which exhibits an annular flange 13 in the vicinity of one of its ends. This flange 13 forms a support for the end 10 of the lever 4, which comprises an orifice in which is engaged the upper end 14 of the peg. This end of the peg 11 comprises, above the flange 13, a cylindrical axial bore serving for the crimping of the peg onto the end 10 of the lever. The crimping is carried out by press-fitting of an appropriate tool into the bore so as to turn down and flatten the upper end 14 of the peg onto the end 10 of the lever as represented in FIG. 3.

During crimping, the lever end 10 applied to the flange 13 of the upper end 14 of the peg experiences the crimping loads directly, and these may make it more fragile. While operational, during the angular adjustment of the blades, these ends of the levers work in bending while the pegs work in torsion, and are subjected to the vibrations of the turbomachine, which make the levers even more fragile. This may eventually cause the breakage of the end 10 of a lever.

The present invention makes it possible to eradicate this risk by virtue of the stress distribution means interposed between the crimped end of the peg and the end 10 of the control lever 4.

Figure 4:
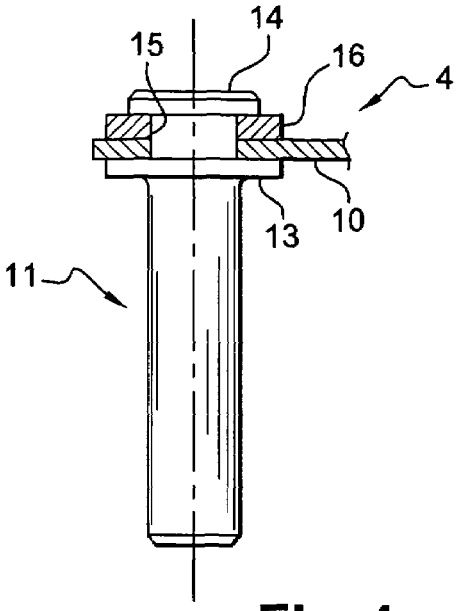
FIG. 4 is a partial diagrammatic view of a first embodiment of the control lever according to the invention.
Figure 5:
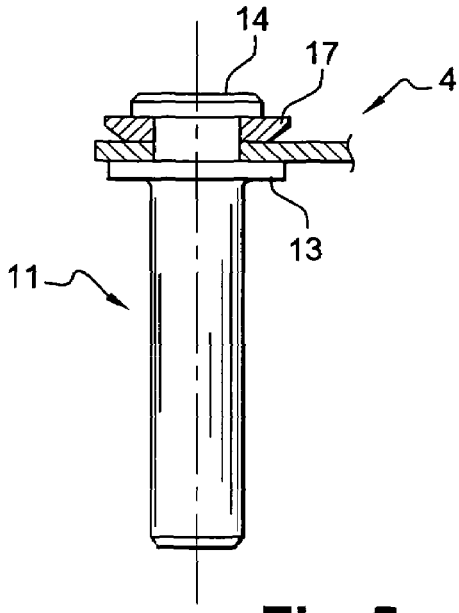
FIG. 5 is a partial diagrammatic view of a second embodiment of the control lever according to the invention.

FIGS. 4 and 5 illustrate two embodiments of these stress distribution means, which are formed of a flat washer 16, 17 with a circular outline exhibiting an axial circular orifice 15 whose diameter is slightly greater than the diameter of the peg 11. The thickness of the washer is of the order of a millimeter and the outer diameter of the washer does not exceed that of the flange 13 of the peg 11.

In the embodiment of FIG. 4, the washer 16 is a washer with two identical parallel plane faces and is made of a more flexible material than that of the lever 4, that is to say of a material which exhibits a Young's modulus of less than that of the material of the lever 4, which is generally made of titanium. The washer 16, for example made of polymer, can deform plastically during the crimping without damaging the control lever 4 and while distributing the stresses over the end 10 of the lever 4.

Figure 6:
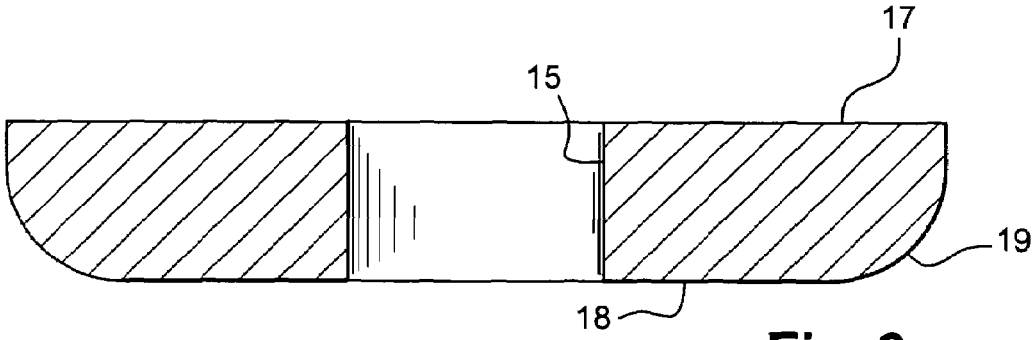
FIGS. 6 and 7 are enlarged diagrammatic views in axial section of the stress distribution washer of the second embodiment of the invention.
Figure 7:
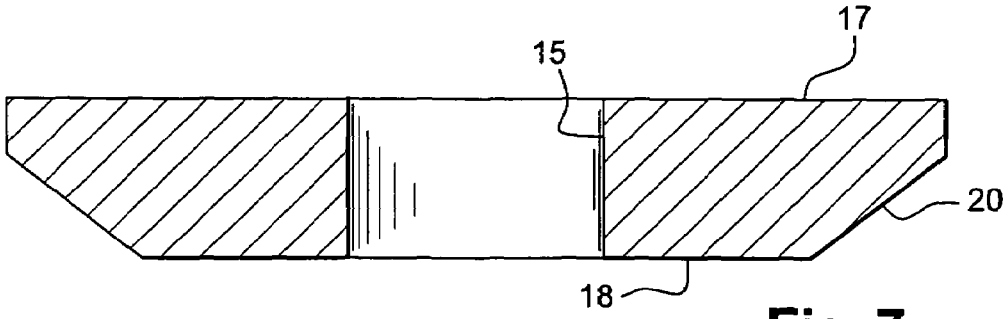

In a second embodiment according to the invention, represented in FIG. 5, the washer 17 interposed between the crimped end of the peg and the lever 4 is made of a material having a greater Young's modulus than that of the material of the control lever 4. This material may be, for example, a polymer or a metal. In this case, as represented on a larger scale in FIGS. 6 and 7, the washer 17 has a surface 18 in contact with the end 10 of the lever 4 and which is formed with a convex annular edge 19 over its entire outer periphery (FIG. 6) or with a chamfered outer edge 20 (FIG. 7).

This configuration of the washer 17 makes it possible not to create any stress peaks in the lever 4 at the outer periphery of the washer, during crimping, the convex rounding 19 or the chamfer 20 making it possible to gradually release the stresses in the material of the lever 4.

The invention claimed is:

1. A control lever for the pitch angle of a blade in a turbomachine, said lever comprising:

a first end configured to be mounted on a blade pivot so as to rotate it and a second end carrying a cylindrical peg configured to mount on a control annulus, this peg being fixed by crimping of one of its ends in an orifice of the second end of the lever and including an annular flange to which is applied the second end of the lever, wherein stress distribution means are sandwiched between the second end of the lever and the crimped end of the peg.

2. The control lever as claimed in claim 1, wherein the stress distribution means comprise a washer.

3. The control lever as claimed in claim 2, wherein the washer is made of a more flexible material than that of the control lever.

4. The control lever as claimed in claim 3, wherein the washer is made of polymer.

5. The control lever as claimed in claim 2, wherein the washer is made of a harder material than that of the control lever.

6. The control lever as claimed in claim 5, wherein the washer is made of polymer or of metal.

7. The control lever as claimed in claim 5, wherein the washer comprises a substantially plane annular surface applied to the second end of the lever and exhibiting a convex or chamfered annular edge at its outer periphery.

8. The control lever as claimed in claim 2, wherein the thickness of the washer is about one millimeter.

9. The control lever as claimed in claim 2, wherein the washer has an outer diameter equal to or slightly less than that of the flange of the peg.

10. The control lever as claimed in claim 2, wherein a first side of the washer is in direct contact with a first surface of the lever, and a second surface of the lever opposite the first surface of the lever is in direct contact with the annular flange.

11. The control lever as claimed in claim 10, wherein a second side of the washer opposite the first side of the washer is in direct contact with the crimped end of the peg.

12. The control lever as claimed in claim 2, wherein the crimped end of the peg contacts the washer along a surface of the crimped end extending in a direction perpendicular to an axis of the peg.

13. The control lever as claimed in claim 1, wherein the lever is made of titanium and the peg is made of steel.

14. The control lever as claimed in claim 1, wherein an inner surface of the orifice in the second end of the lever is in direct contact with the peg.

* * * * *